US008427265B2

(12) United States Patent
Hachiya et al.

(10) Patent No.: US 8,427,265 B2
(45) Date of Patent: Apr. 23, 2013

(54) LAMINATED INDUCTOR

(75) Inventors: Masahiro Hachiya, Takasaki (JP); Takuya Ishida, Takasaki (JP); Takayuki Arai, Takasaki (JP); Kenji Otake, Takasaki (JP); Hitoshi Matsuura, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/452,635

(22) Filed: Apr. 20, 2012

(65) Prior Publication Data

US 2012/0274438 A1 Nov. 1, 2012

(30) Foreign Application Priority Data

Apr. 27, 2011 (JP) ..... 2011-100095
Mar. 23, 2012 (JP) ..... 2012-068444

(51) Int. Cl.
*H01F 27/02* (2006.01)

(52) U.S. Cl.
USPC ..... 336/83

(58) Field of Classification Search ..... 336/65, 336/83, 200, 232, 220–223, 233–234
See application file for complete search history.

(56) References Cited

U.S. PATENT DOCUMENTS 5,522,946 A 6/1996 Tomita et al.
6,392,525 B1 5/2002 Kato et al.
6,784,782 B2 8/2004 Inoue et al.
6,855,222 B2 * 2/2005 Konoue et al. ..... 156/89.16
8,018,313 B2 9/2011 Tada et al.
2007/0290161 A1 12/2007 Tokuoka et al.
2008/0029300 A1 2/2008 Harada et al.
2008/0061264 A1 3/2008 Maeda et al.
2008/0152897 A1 6/2008 Maeda et al.
2008/0231409 A1 9/2008 Kugai et al.
2010/0289609 A1 11/2010 Liao et al.
2011/0024670 A1 2/2011 Otsuki et al.
2011/0133881 A1 * 6/2011 Nakajima et al. ..... 336/200

(Continued)

FOREIGN PATENT DOCUMENTS

JP H09-074011 A 3/1997
JP 2000-030925 A 1/2000

(Continued)

OTHER PUBLICATIONS

U.S. Appl. No. 13/092,381, Coil-Type Electronic Component and Its Manufacturing Method, filed Apr. 22, 2011.

(Continued)

*Primary Examiner* — Tuyen Nguyen
(74) *Attorney, Agent, or Firm* — Law Office of Katsuhiro Arai

(57) ABSTRACT

A laminated inductor includes a laminate constituted by multiple magnetic material layers, and coil conductors formed in a spiral pattern in the laminate. The magnetic material layers are layers of a magnetic material having multiple metal grains constituted by a Fe—Si-M soft magnetic alloy and oxide film formed on the surface of the metal grains. The magnetic material has bonding portions where adjacent metal grains are bonded via the oxide film formed on the respective surfaces of the adjacent metal grains as well as bonding portions of metal grains bonding to each other in areas where no oxide film is present, and at least some of the voids generated by agglomeration of the metal grains are filled with a resin material.

6 Claims, 3 Drawing Sheets

U.S. PATENT DOCUMENTS

| | | | | |
|---|---|---|---|---|
| 2011/0267167 | A1 | 11/2011 | Ogawa et al. | |
| 2012/0038449 | A1 | 2/2012 | Ogawa et al. | |
| 2012/0188049 | A1* | 7/2012 | Matsuura et al. | 336/212 |
| 2012/0274437 | A1* | 11/2012 | Matsuura et al. | 336/221 |

FOREIGN PATENT DOCUMENTS

| | | | |
|---|---|---|---|
| JP | 2001-011563 | A | 1/2001 |
| JP | 2001-118725 | A | 4/2001 |
| JP | 2002-305108 | A | 10/2002 |
| JP | 2002-313620 | A | 10/2002 |
| JP | 2002-343618 | A | 11/2002 |
| JP | 2007-019134 | A | 1/2007 |
| JP | 2007-027354 | A | 2/2007 |
| JP | 2007-123703 | A | 5/2007 |
| JP | 2007-299871 | A | 11/2007 |
| JP | 2008-028162 | A | 2/2008 |
| JP | 2008-041961 | A | 2/2008 |
| JP | 2008-195986 | A | 8/2008 |
| JP | 2009-088496 | A | 4/2009 |
| JP | 2009-088502 | A | 4/2009 |
| JP | 2011-249774 | A | 12/2011 |
| WO | 2009/128425 | A1 | 10/2009 |

OTHER PUBLICATIONS

U.S. Appl. No. 13/277,018, Coil-Type Electronic Component and Its Manufacturing Method, filed Oct. 19, 2011.
U.S. Appl. No. 13/313,999, Magnetic Material and Coil Component Using the Same, filed Dec. 7, 2011.
U.S. Appl. No. 13/313,982, Coil Component, filed Dec. 7, 2011.
U.S. Appl. No. 13/348,926, Coil-Type Electronic Component and Its Manufacturing Method, filed Jan. 12, 2012.
U.S. Appl. No. 13/351,078, Coil Component, filed Jan. 16, 2012.
U.S. Appl. No. 13/426,404, Laminated Inductor, filed Mar. 21, 2012.
U.S. Appl. No. 13/428,600, Laminated Inductor, filed Mar. 23, 2012.
U.S. Appl. No. 13/642,467, Coil-Type Component and Process for Producing Same, filed Oct. 19, 2012.
U.S. Appl. No. 13/662,035, Coil-Type Electronic Component, filed Oct. 26, 2012.
U.S. Appl. No. 13/679,291, Laminated Inductor, filed Nov. 16, 2012.
U.S. Appl. No. 13/708,614, Coil-Type Electronic Component, filed Dec. 7, 2012.

* cited by examiner

[Fig. 1]
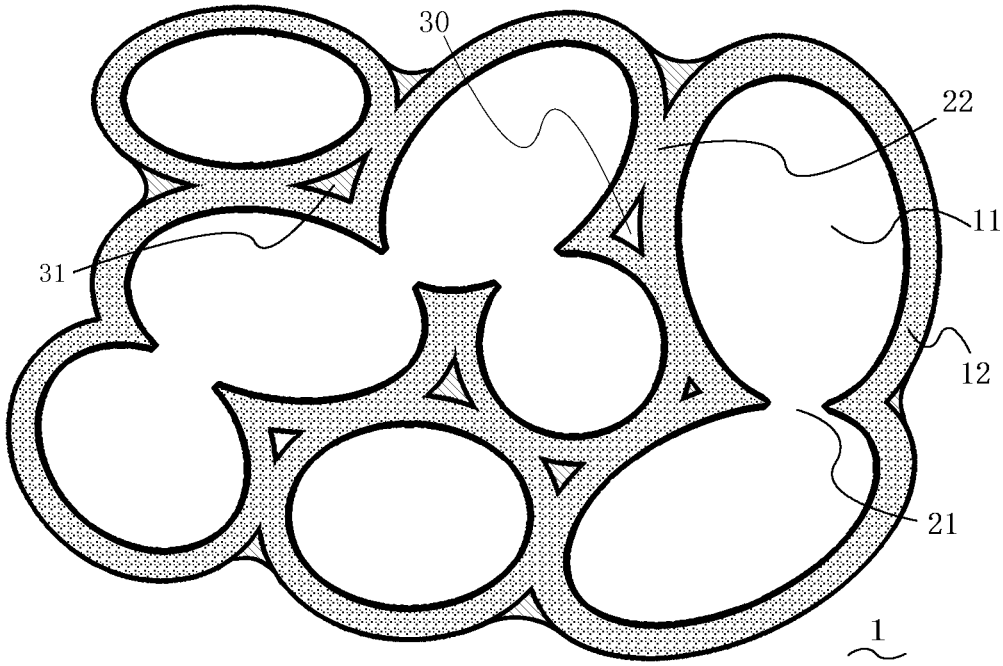
[Fig. 2]
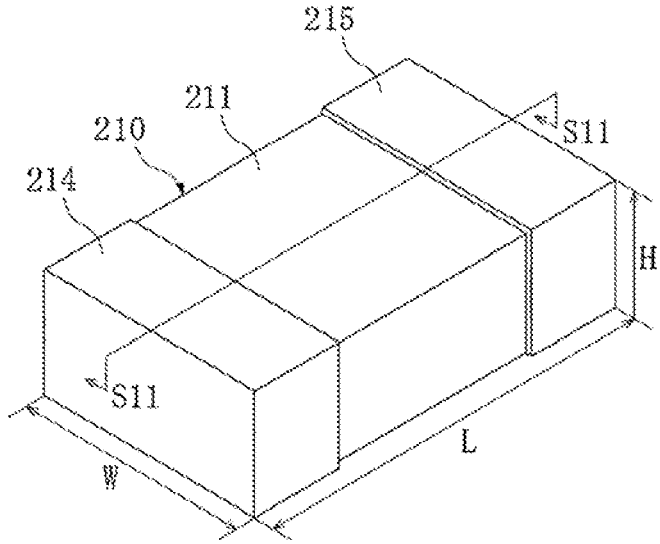

[Fig. 3]
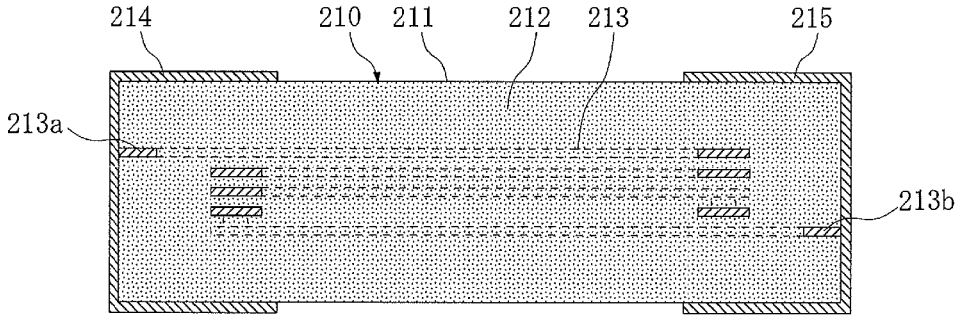
[Fig. 4]
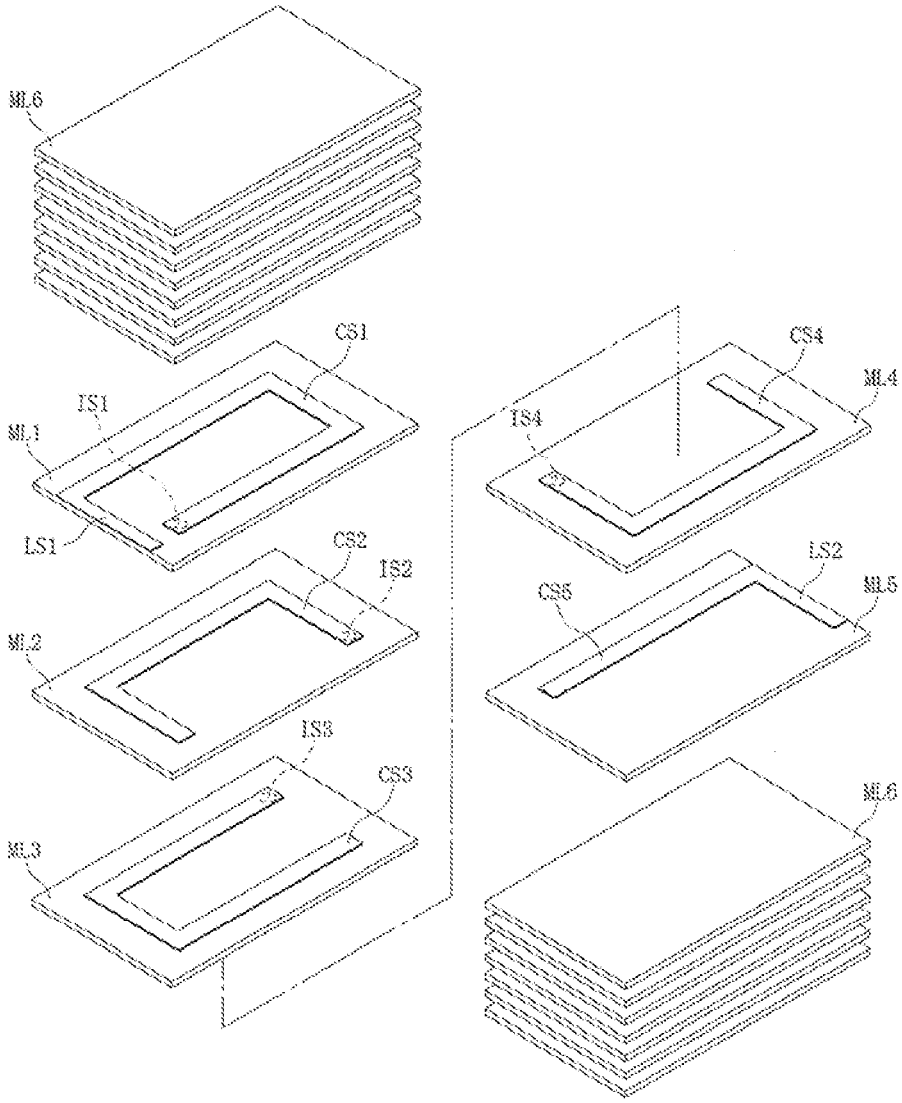

[Fig. 5]
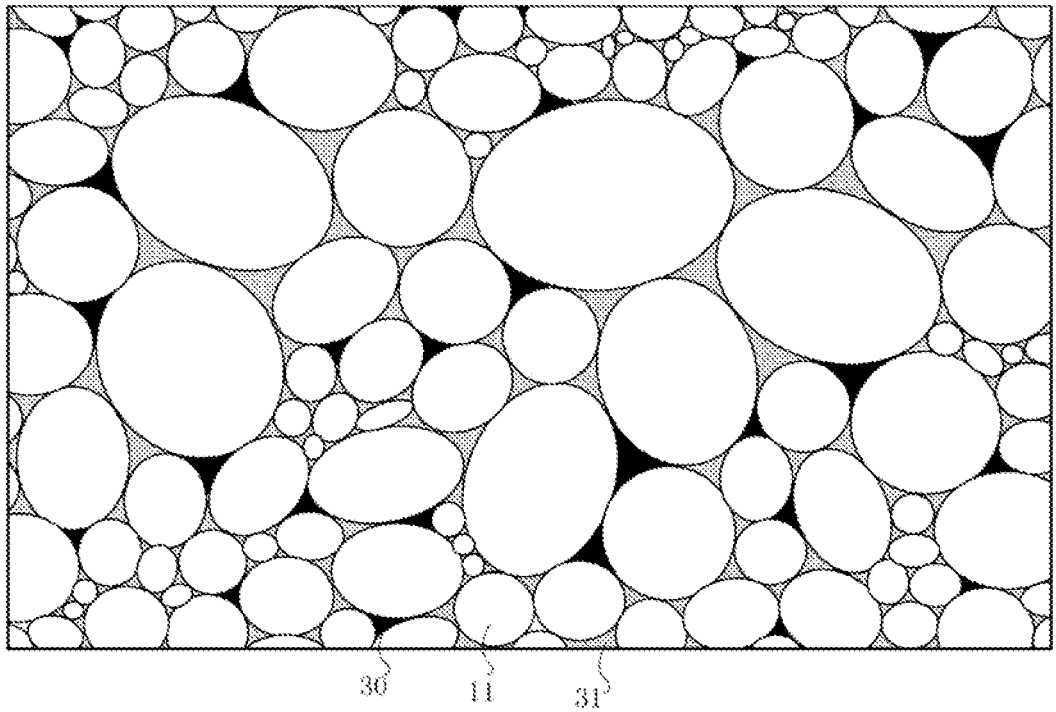
[Fig. 6]
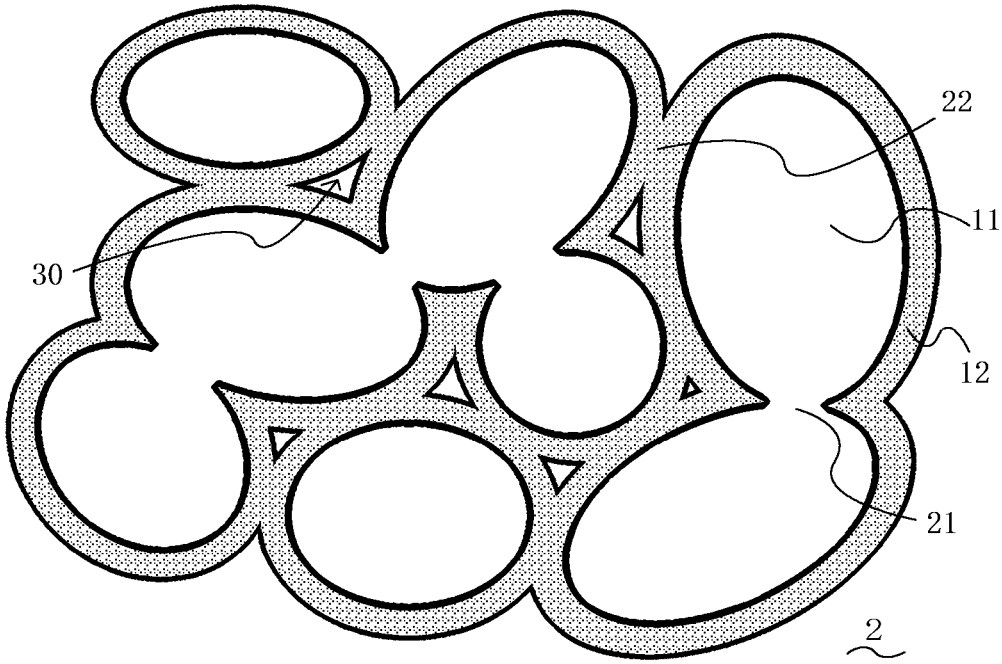

LAMINATED INDUCTOR

BACKGROUND

1. Field of the Invention

The present invention relates to a laminated inductor.

2. Description of the Related Art

Laminated inductors which are compact electronic components of laminated coil type that can be surface-mounted on a circuit board, are being developed. Ferrite cores, cut cores made of a thin metal sheet, and powder magnetic cores, have traditionally been used as magnetic cores for choke coils used at high frequencies.

These types of coil components are facing a demand for electrical current amplification (meaning a higher rated current) in recent years and, to meet this demand, switching the material for the magnetic body from ferrite representing the current practice, to Fe alloy, is being examined.

Patent Literature 1 discloses a method for producing a magnetic body for a laminated coil component, which is to stack magnetic layers formed by a magnetic paste containing Fe—Cr—Si alloy grains and a glass component, with conductive patterns, and then sinter the stack in a nitrogen atmosphere (reducing atmosphere), after which the sintered material is impregnated with a thermosetting resin.

PATENT LITERATURE

[Patent Literature 1] Japanese Patent Laid-open No. 2007-27354

SUMMARY

However, the invention under Patent Literature 1 adopts a composite structure of metal powder and resin to ensure insulation property, which prevents a sufficient magnetic permeability from being achieved. Also, the heat treatment temperature must be kept low to maintain the resin, which prevents the Ag electrode from becoming denser and, consequently, sufficient L and Rdc characteristics from being achieved.

In addition, there is a need for insulation treatment given the low insulation property of the metal magnetic body. Furthermore, improvement of reliability characteristics such as high-temperature loading and moisture resistance is also desired.

In consideration of the above, the object of the present invention is to provide a laminated inductor offering an improved magnetic permeability and improved insulation resistance, while improving reliability characteristics such as high-temperature loading and moisture resistance.

After studying in earnest, the inventors completed the present invention described below.

The laminated inductor conforming to the present invention comprises a laminate constituted by multiple magnetic material layers, and coil conductors formed in a spiral pattern in the laminate. Each coil conductor has a conductive pattern formed on a magnetic material layer, and via hole conductors that penetrate through the magnetic material layer and electrically connect multiple conductive patterns. Here, the magnetic material constituting the magnetic material layer has multiple metal grains constituted by a Fe—Si-M soft magnetic alloy (where M is a metal element that oxidizes more easily than Fe) and oxide film formed on the surface of metal grains. This oxide film is made of an oxide of the soft magnetic alloy. The magnetic material has bonding portions where adjacent metal grains are connected via the oxide film formed on the respective surfaces of the adjacent metal grains, as well as bonding portions where metal grains are interconnected in areas where no oxide film is present. Also, at least some of the voids generated by agglomeration of the metal grains are filled with a resin material.

Preferably the resin material is filled in at least 15% of the area corresponding to regions where no metal grain nor oxide film is present, as observed on a cross section of the magnetic material layer. Also, preferably the resin material is constituted by at least one type of resin selected from the group constituting of silicone resins, epoxy resins, phenol resins, silicate resins, urethane resins, imide resins, acrylic resins, polyester resins and polyethylene resins.

According to the present invention, a highly reliable laminated inductor comprising a magnetic material that achieves both high magnetic permeability and high insulation resistance is provided.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a section view that schematically illustrates the fine structure of a magnetic material conforming to the present invention.

FIG. 2 is an external perspective view of a laminated inductor.

FIG. 3 is an enlarged section view along line S11-S11 in FIG. 2.

FIG. 4 is an exploded view of the main component body shown in FIG. 2.

FIG. 5 is a schematic section view of a magnetic material conforming to the present invention.

FIG. 6 is a section view that schematically illustrates the fine structure of a magnetic material conforming to a comparative example.

DESCRIPTION OF THE SYMBOLS

1, 2: Magnetic material
11: Metal grain
12: Oxide film
21: Bond of metal grains
22: Bond via oxide film
30: Void
31: Resin material
210: Laminated inductor
211: Main component body
212: Magnetic body
213: Coil
214, 215: External terminal

DETAILED DESCRIPTION

The present invention is described in detail by referring to the drawings as deemed appropriate. It should be noted, however, that the present invention is not at all limited to the embodiments illustrated and that the scale of each part of the drawings is not necessarily accurate because characteristic parts of the invention may be exaggerated in the drawings.

According to the present invention, the magnetic material layer is constituted by a magnetic material which is a compact of specified grains.

FIG. 1 is a section view that schematically illustrates the fine structure of a magnetic material conforming to the present invention. Under the present invention, the magnetic material 1 is understood, microscopically, as an assembly of many metal grains 11 that were originally independent, where an oxide film 12 is formed at least partially, or preferably almost entirely, around individual metal grains 11, with this oxide film 12 ensuring the insulation property of the magnetic material 1. Metal grains 11 adjacent to each other are bonded together primarily by bonding to each other the oxide films 12 formed around the respective metal grains 11, to constitute the magnetic material 1 having a specific shape. In addition to bonding portions 22 of oxide films 12 bonding to each other, there are, in part, bonding portions 21 of metal parts of adjacent metal grains 11 bonding to each other. Conventional magnetic materials used a hardened organic resin matrix in which agglomerates of individual magnetic grains or several magnetic grains are distributed, or a hardened glass component matrix in which agglomerates of individual magnetic grains or several magnetic grains are distributed.

As explained later, the magnetic material 1 contains a resin material, but only in a manner filling the voids between metal grains and the coupling elements that form the magnetic material 1 are the two types of bonding portions 21, 22 mentioned above. Even when the resin material is removed from the magnetic material 1, a continuous structure by means of the two types of bonding portions 21, 22 is still found. Under the present invention, it is preferred that there is virtually no matrix of a glass component.

Individual metal grains 11 are primarily constituted by a specific soft magnetic alloy. Under the present invention, metal grains 11 comprise a Fe—Si-M soft magnetic alloy. Here, M is a metal element that oxidizes more easily than Fe, typically Cr (chromium), Al (aluminum), Ti (titanium), etc., but preferably Cr or Al.

If the soft magnetic alloy is a Fe—Cr—Si alloy, the Si content is preferably 0.5 to 7.0 percent by weight, or more preferably 2.0 to 5.0 percent by weight. A higher Si content is preferred in that it leads to high resistance and high magnetic permeability, while a lower Si content is associated with good formability, and the above preferable ranges are proposed in consideration of both.

If the soft magnetic alloy is a Fe—Cr—Si alloy, the Cr content is preferably 2.0 to 15 percent by weight, or more preferably 3.0 to 6.0 present by weight. Presence of Cr is preferred because it enters a passive state during heat treatment to suppress excessive oxidization, while adding strength and insulation resistance, but less Cr is preferred from the viewpoint of improving magnetic characteristics, and the above preferable ranges are proposed in consideration of both.

If the soft magnetic alloy is a Fe—Si—Al alloy, the Si content is preferably 1.5 to 12 percent by weight. A higher Si content is preferred in that it leads to high resistance and high magnetic permeability, while a lower Si content is associated with good formability, and the above preferable range is proposed in consideration of both.

If the soft magnetic alloy is a Fe—Si—Al alloy, the Al content is preferably 2.0 to 8 percent by weight.

It should be noted that the above preferable contents of each metal component of the soft magnetic alloy assume that the total amount of all alloy components is 100 percent by weight. In other words, composition of oxide film is excluded in the calculations of the above preferable contents.

If the soft magnetic alloy is a Fe—Si-M alloy, the remainder of Si and M is preferably Fe except for unavoidable impurities. Metals that may be contained other than Fe, Si and M include metals such as magnesium, calcium, titanium, manganese, cobalt, nickel and copper, as well as non-metals such as phosphorus, sulfur and carbon.

The chemical composition of the alloy constituting each metal grain 11 in the magnetic material 1 can be calculated by, for example, capturing an image of the section of the magnetic material 1 using a scanning electron microscope (SEM) and then conducting an energy dispersive X-ray spectroscopy (EDS) and calculating the composition by the ZAF method.

The magnetic material conforming to the present invention can be manufactured by compacting metal grains constituted by a specified soft magnetic alloy as mentioned above, and then heat-treating the metal grains. At this time, heat treatment is preferably applied in such a way that, not only the oxide film present on the material metal grain (hereinafter also referred to as "material grain") remains, but an oxide film 12 is also formed via partial oxidization of the metal part of the material metal grain. As such, the oxide film 12 under the present invention is an oxide of the alloy grain constituting the metal grain 11, and primarily produced via oxidization of the surface of the metal grain 11. In a preferable embodiment, the magnetic material conforming to the present invention does not contain any oxide other than that produced via oxidization of the metal grain 11, such as silica or any phosphate compound.

Individual metal grains 11 constituting the magnetic material 1 may have an oxide film 12 formed at least partially around them. An oxide film 12 may be formed in the material grain stage before the magnetic material 1 is formed, or it may be produced in the compacting process by keeping the presence of oxide film to zero or an absolute minimum in the material grain stage. Presence of oxide film 12 can be recognized as contrast (brightness) differences on an image of around 3,000 magnifications taken by a scanning electron microscope (SEM). Insulation property of the entire magnetic material is assured by the presence of oxide film 12.

Preferably the oxide film 12 contains more metal M element than Fe element in mol. One way to achieve an oxide film 12 having this constitution is to use a material grain that contains less or an absolute minimum of iron oxide and oxidize the surface of the alloy via heating, etc., in the process of obtaining the magnetic material 1. This selectively oxidizes metal M that oxidizes more easily than Fe, and consequently the mol ratio of metal M contained in the oxide film 12 becomes greater than that of Fe. A higher content of metal M element than Fe element in the oxide film 12 has the benefit of suppressing excessive oxidization of alloy grains.

The method for measuring the chemical composition of the oxide film 12 in the magnetic material 1 is as follows. First, the magnetic material 1 is fractured or otherwise a cross section is exposed. Next, the surface is smoothed via ion milling, etc., and the smoothed surface is captured with a scanning electron microscope (SEM) to perform an energy dispersive X-ray spectroscopy (EDS) of the oxide film 12 and calculate its chemical composition according to the ZAF method.

The content of metal M in the oxide film 12 is preferably 1.0 to 5.0 mol, or more preferably 1.0 to 2.5 mol, or even more preferably 1.0 to 1.7 mol, per 1 mol of Fe. A higher M content is preferred in that it suppresses excessive oxidization, while a lower M content is preferred because metal grains are sintered together. The M content can be increased by applying heat treatment in a weak oxidizing atmosphere, for example, while the M content can be decreased by applying heat treatment in a strong oxidizing atmosphere, for example.

In the magnetic material 1, grains are bonded together primarily via bonding portions 22 of oxide films 12 bonding to each other. Presence of bonding portions 22 of oxide films 12 bonding to each other can be clearly determined by, for example, visually confirming that the oxide films 12 on adjacent metal grains 11 are of an identical phase, using a SEM observation image, etc., taken at around 3,000 magnifications. Presence of bonding portions 22 of oxide films 12 bonding to each other improves the mechanical strength and insulation property. Preferably oxide films 12 on adjacent metal grains 11 are bonded together throughout the magnetic material 1, but the mechanical strength and insulation property improve sufficiently as long as there are at least in part such bonding portions, and this mode is also considered an embodiment of the present invention. Preferably the number of bonding portions 22 of oxide films 12 bonding to each other present is equal to or greater than the number of metal grains 11 contained in the magnetic material 1. Also, as explained later, bonding portions 21 of metal grains 11 bonding to each other, not involving bonding oxide films 12 to each other, may be present in part. Furthermore, a mode (not illustrated) where adjacent metal grains 11 are only making physical contact with or positioned close to each other, without forming a bond bonding oxide films 12 to each other or a bond bonding metal grains 11 to each other, may be present in part.

One way to form a bond 22 bonding oxide films 12 to each other is, for example, applying heat treatment at the specified temperature mentioned later in an atmosphere of oxygen (such as in atmosphere) when the magnetic material 1 is manufactured.

According to the present invention, bonding portions 21 of metal grains 11 bonding to each other, not just bonding portions 22 of oxide films 12 bonding to each other, are present in the magnetic material 1. As with the presence of bonding portions 22 of oxide films 12 bonding to each other as mentioned above, presence of bonding portions 21 of metal grains 11 bonding to each other can be clearly determined by, for example, visually confirming that adjacent metal grains 11 are of an identical phase and have bonding points therebetween, using a SEM observation image, etc., taken at around 3,000 magnifications. Presence of bonding portions 21 of metal grains 11 bonding to each other improves the magnetic permeability further.

Ways to form a bond 21 of metal grains 11 include, for example, using a material grain having less oxide film, adjusting the temperature and oxygen partial pressure during the heat treatment applied to manufacture the magnetic material 1 as explained later, and adjusting the compacting density when obtaining the magnetic material 1 from material grains. For the temperature during the heat treatment, a level at which metal grains 11 bond together but oxides do not generate easily can be proposed. A specific preferable temperature range is discussed later. For the oxygen partial pressure, it may be the oxygen partial pressure in atmosphere, for example, where a lower oxygen partial pressure results in less generation of oxides and consequently more bonding of metal grains 11.

The magnetic material conforming to the present invention can be manufactured by compacting metal grains that are constituted by a specified alloy. At this time, a grain compact of a desired overall shape can be obtained by allowing adjacent metal grains to bond together primarily via oxide film, and in part not via oxide film.

The metal grain (material grain) used as the manufacturing material for the magnetic material conforming to the present invention is preferably one constituted by a Fe-M-Si alloy, or more preferably one constituted by a Fe—Cr—Si alloy. The alloy composition of the material grain is reflected in the alloy composition of the magnetic material finally obtained. This means that a desired alloy composition of the material grain can be selected as deemed appropriate according to the alloy composition of the magnetic material to be finally obtained, where the preferable range of the alloy composition of the material grain is the same as the preferable range of the alloy composition of the magnetic material mentioned above. Individual material grains may be covered with an oxide film. In other words, individual material grains may be constituted by a specified soft magnetic alloy at the center, and an oxide film formed at least partially around the center as a result of oxidization of the soft magnetic alloy.

The sizes of individual material grains are virtually equivalent to those of the grains constituting the magnetic material 1 to be finally obtained. Considering the magnetic permeability and eddy current loss in the grain, the size of the material grain is such that d50 is preferably 2 to 30 μm, or more preferably 2 to 20 μm, while an even more preferable lower limit of d50 is 5 μm. The d50 of the material grain can be measured using a laser diffraction/scattering measurement apparatus.

The material grain is manufactured by the atomization method, for example. As mentioned above, not only bonding portions 22 where adjacent metal grains are bonded via oxide film 12 but also bonding portions 21 of metal grains 11 bonding to each other are present in the magnetic material 1. Accordingly, it is better for the material grain not to have excessive oxide film, although oxide film can be present. Grains manufactured by the atomization method are preferred in that they have relatively less oxide film. The ratio of the alloy-based core and oxide film in the material grain can be quantified as follows. The material grain is analyzed by XPS and, by focusing on the Fe peak intensity, the integral value at the peak where Fe exists as metal (706.9 eV), or $Fe_{Metal}$, and integral value at the peak where Fe exists as oxide, or $Fe_{Oxide}$, are obtained and then $Fe_{Metal}/(Fe_{Metal}+Fe_{Oxide})$ is calculated to quantify the aforementioned ratio. Here, when $Fe_{Oxide}$ is calculated, a normal distribution around the binding energies of three types of oxides, namely $Fe_2O_3$ (710.9 eV), FeO (709.6 eV) and $Fe_3O_4$ (710.7 eV), is superimposed for fitting with measured data. Then, $Fe_{Oxide}$ is calculated as the sum of the resulting peak-isolated integral areas. The aforementioned value is preferably 0.2 or more in order to facilitate formation of alloy bonding portions 21 during the heat treatment and thereby raise the magnetic permeability. No specific upper limit is set for the aforementioned value, but the upper limit may be set to 0.6, for example, to facilitate manufacturing, etc., and a preferable upper limit is 0.3. Means for raising the aforementioned value include applying heat treatment in a reducing atmosphere, or applying a chemical treatment involving removal of surface oxide layer using acid, for example. The reduction treatment may be implemented by, for example, holding the material in an atmosphere of nitrogen or argon containing 25 to 35% of hydrogen, at temperatures of 750 to 850° C. for 0.5 to 1.5 hours. The oxidization treatment may be implemented by, for example, holding the material in atmosphere at temperatures of 400 to 600° C. for 0.5 to 1.5 hours.

The aforementioned material grain may be manufactured by any known alloy grain manufacturing method, or a commercial product such as PF20-F by Epson Atmix or SFR-FeSiAl by Nippon Atomized Metal Powders, for example, may be used. It is highly likely that commercial products do not consider the value of $Fe_{Metal}/(F_{Metal}+Fe_{Oxide})$ mentioned above, so when using a commercial product, it is desirable to screen material grains or apply a pretreatment in the form of heat treatment or chemical treatment as mentioned above.

The structure of the laminated inductor device is not specifically limited, and any known structure can be used as deemed appropriate. Non-definitive examples are explained in the section "Examples" by referring to FIGS. 2 to 4, etc. The laminated inductor to which the present invention is applied has a structure wherein a majority of the coil conductor is buried in the laminate of magnetic layers. The coil conductor is typically a spirally formed coil, but it may also be a helix coil, meandering conductive wire or straight conductive wire, for example.

The coil conductor typically has coil segments and relay segments. Coil segments are alternately stacked with magnetic layers to constitute a laminate structure. Relay segments are formed in a manner penetrating through the magnetic layers. Relay segments are formed in a manner connecting multiple coil segments conductively. FIG. 4 is a schematic exploded view of a typical laminated inductor. In the embodiment illustrated, the coil conductor has a coil structure wherein coil segments CS1 to CS5 and relay segments IS1 to IS4 connecting these coil segments CS1 to CS5 are spirally integrated, where the coil segments CS1 to CS4 have a C shape and the coil segment CS5 has a band shape, while the relay segments IS1 to IS4 form a pillar penetrating through the magnetic layers ML1 to ML4.

According to the present invention, the coil segments+CS1 to CS5 and relay segments IS1 to IS4 are made of a conductive material. Non-definitive examples of the conductive material include materials containing Ag, Au, Cu, Pt, Pd, etc. Preferably the conductive material is a material containing Ag, where the material containing Ag is typically a metal material containing Ag more than other elements, such as a mixture or alloy of 100 parts by weight of Ag and 50 parts by weight or less of other metal. Non-definitive examples of such other metal include Au, Cu, Pt, Pd, etc.

A typical but non-definitive manufacturing method of the laminated inductor conforming to the present invention is explained below. To manufacture the laminated inductor, first a doctor blade, die coater or other coating machine is used to apply a prepared magnetic paste (slurry) to the surface of a base film made of resin, etc. The coated base film is then dried with a hot-air dryer or other dryer to obtain a green sheet. The magnetic paste contains soft magnetic alloy grains and, typically, a polymer resin used as a binder, and a solvent.

The magnetic paste preferably contains a polymer resin used as a binder. The type of polymer resin is not specifically limited, and may be polyvinyl butyral (PVB) or other polyvinyl acetal resin, for example. The type of solvent used in the magnetic paste is not specifically limited, and may be butyl carbitol or other glycol ether, for example. The blending ratio of soft magnetic alloy grains, polymer resin, solvent, etc., of the magnetic paste can be adjusted as deemed appropriate, and a desired viscosity of the magnetic paste, etc., can also be set through such adjustment.

Any conventional technology can be used as a specific method to apply the magnetic paste or dry it to obtain the green sheet.

Next, a stamping machine, laser processing machine or other piercing machine is used to pierce the green sheet to form through holes in a specified arrangement. The arrangement of through holes is set in such a way that, when the sheets are stacked on top of each other, the through holes filled with the conductor (i.e., relay segments) and coil segments together form the coil conductor. For the arrangement of through holes for forming the coil conductor, or shape of conductive patterns for forming the coil segment, any conventional technology can be used as deemed appropriate and a specific example is also explained later in the section "Examples" by referring to the drawings.

Preferably a conductive paste is used to fill the through holes and also to print the conductive patterns. The conductive paste contains a conductive material (an example where a material containing Ag is explained below, but the conductive material is not at all limited to the foregoing) and, typically, a polymer resin used as a binder, and a solvent.

A desired grain size of the material containing Ag, which defines the conductive grain, can be selected as deemed appropriate, where d50 is preferably 1 to 10 μm based on volume. The d50 of the conductive grain is measured using a grain size/granularity distribution measurement apparatus using the laser diffraction/scattering method (such as Microtrack by Nikkiso).

The conductive paste preferably contains a polymer resin used as a binder. The type of polymer resin is not specifically limited, and may be polyvinyl butyral (PVB) or other polyvinyl acetal resin, for example. The type of solvent used in the conductive paste is not specifically limited, and may be butyl carbitol or other glycol ether, for example. The blending ratio of material containing Ag, polymer resin, solvent, etc., of the conductive paste can be adjusted as deemed appropriate, and a desired viscosity of the conductive paste, etc., can also be set through such adjustment.

Next, a screen printer, gravure printer or other printer is used to print the conductive paste on the surface of the green sheet, which is then dried using a hot-air dryer or other dryer to form a conductive pattern corresponding to the coil segment. During printing, the aforementioned through holes are partially filled with the conductive paste. As a result, the conductive paste filled in the through holes and the printed conductive pattern together constitute the shape of a coil conductor.

A suction transfer machine and press machine are used to stack multiple units of thus printed green sheets in a specified order, and then thermally compress the stack to produce a laminate. Next, a dicing machine, laser processing machine or other cutting machine is used to cut the laminate to the size of the main component body, to produce a chip-before-heat-treatment that contains the magnetic material and coil conductor before heat treatment.

A sintering furnace or other heating apparatus is used to heat-treat the chip-before-heat-treatment in an atmosphere or other oxidizing atmosphere. The atmosphere of heat treatment is not specifically limited as long as it is an oxidizing atmosphere, and the oxygen concentration during heating is preferably 1% or more as it facilitates generation of both bonding portions 22 of oxide films bonding to each other and bonding portions 21 of metals bonding to each other. No specific upper limit is set for the oxygen concentration, but the oxygen concentration in atmosphere (approx. 21%) can be used as the upper limit in consideration of manufacturing cost, etc. The heating temperature is preferably 600° C. or above to facilitate generation of oxide film 12 as well as bonding portions of oxide films 12 bonding to each other, and 900° C. or below to suppress oxidization to a moderate level and thereby maintain the presence of bonding portions 21 of metals bonding to each other while raising the magnetic permeability. The heating temperature is more preferably 700 to 800° C. The heating time is preferably 0.5 to 3 hours to facilitate generation of both bonding portions 22 of oxide films 12 bonding to each other as well as bonding portions 21 of metals bonding to each other. The mechanism whereby bonds via oxide film 12 and bonding portions 21 of metal grains bonding to each other are generated is considered similar to so-called ceramics sintering in a temperature region higher than 600° C., for example. In other words, the inventors gained a new insight that, during this heat treatment, it is important that (A) oxide film comes in full contact with the oxidizing atmosphere and metal elements are supplied from metal grains as necessary to generate the oxide film, and (B) adjacent oxide films make direct contact with each other so as to mutually allow the material that constitutes the oxide films to diffuse into each other. Accordingly, preferably during the heat treatment, there is virtually no thermosetting resin, silicone or other substance that may remain in a high temperature region of 600° C. or above.

In the chip-before-heat-treatment, many fine voids are present among individual soft magnetic alloy grains and these fine voids are normally filled with a mixture of solvent and binder. This mixture dissipates as the temperature rises and fine voids turn into pores. In a high temperature region near the aforementioned maximum temperature, soft magnetic alloy grains are packed closely together to form the magnetic body and, typically when that happens, an oxide film is formed on the surface of each soft magnetic alloy grain. At this time, the material containing Ag is sintered to form a coil conductor. This way, a laminate of magnetic materials and coil conductors is obtained.

Normally, external terminals are formed after the heat treatment. A dip coater, roller coater or other coating machine is used to apply a prepared conductive paste to both ends of the sintered material in the lengthwise direction, and the coated sintered material is then baked in a sintering furnace or other heating apparatus under the conditions of approx. 600° C. for approx. 1 hour, for example, to form external terminals. For the conductive paste for external terminals, the aforementioned paste for conductive pattern printing or other similar paste may be used as deemed appropriate.

The obtained magnetic material 1 has voids 30 inside. A resin material is filled at least partially in these voids 30. Means for filling the resin material include, for example, soaking the magnetic material 1 in the resin material in liquid state, in a solution of the resin material or other liquid form of the resin material and lowering the manufacturing system pressure, or applying the aforementioned liquid form of the resin material to the magnetic material 1 to have it seep into the voids 30 near the surface. Filling the resin material 31 in the voids 30 of the magnetic material 1 provides the advantage of increasing the strength and suppressing the moisture absorption of the material, which specifically means that moisture no longer enters the magnetic material easily, and consequently insulation resistance does not drop easily, at high humidity. The resin material 31 is not specifically limited and examples include organic resins, silicone resins, etc., but preferably at least one type of resin is used which is selected from a group that contains silicone resins, epoxy resins, phenol resins, silicate resins, urethane resins, imide resins, acrylic resins, polyester resins and polyethylene resins.

Preferably the resin material is filled in such a way that at least the specified percentage of voids generated in the magnetic material are filled. The degree of filling of the resin material is quantified by mirror-surface polishing or ion milling (CP) the laminated inductor to be measured and then observing the polished/milled surface using a scanning electron microscope (SEM). The specific method is as follows. First, the measuring target is polished in such a way that a cross section that cuts through the target in the thickness direction and passes through the center of the laminate is exposed. A scanning electron microscope (SEM) is then used to capture at 3,000 magnifications a part of the obtained cross section near the center, to obtain a compositional image. FIG. 5 is a schematic drawing showing the obtained image. The observed image shows differences in contrast (brightness) on the compositional image, resulting from different constituent elements. The metal grains 11, oxide films (not illustrated), portions 31 filled with the resin material, and voids 30, are identified in the order of brightness from the highest to lowest. Using the observed image, the ratio of the area of voids 30 to the area corresponding to regions where no metal grain 11 nor oxide film is present is calculated and this ratio is defined as the void ratio (%). Then, the resin filling ratio (%) is calculated by (100−Void ratio). The resin filling ratio is typically about 5% or more, preferably about 10% or more, more preferably about 15% or more (e.g., about 15% to about 50%) to better achieve the effects of the present invention.

EXAMPLES

The present invention is explained specifically using examples below. It should be noted, however, that the present invention is not at all limited to the embodiments described in the examples.

Examples 1 to 6

Material Grain

A commercial alloy powder produced by the atomization method, which has a composition of 4.5 percent by weight of Cr, 3.5 percent by weight of Si and remainder being Fe, and an average grain size d50 of 6 μm, was used as the material grain. When the surface of the assembly of this alloy powder was analyzed by XPS and $Fe_{Metal}/(Fe_{Metal}+Fe_{Oxide})$ was calculated as mentioned above, the result was 0.25.

In these examples, a laminated inductor was manufactured as a coil component.

FIG. 2 is an external perspective view of a laminated inductor. FIG. 3 is an enlarged section view along line S11-S11 in FIG. 2. FIG. 4 is an exploded view of the main component body shown in FIG. 2. The laminated inductor 210 manufactured in these examples has, according to FIG. 2, a length L of approx. 3.2 mm, width W of approx. 1.6 mm and height H of approx. 0.8 mm, with its overall shape being a rectangular solid. This laminated inductor 210 has a main component body 211 of a rectangular solid shape, and a pair of external terminals 214, 215 provided at both ends of the main component body 211 in the lengthwise direction. As shown in FIG. 3, the main component body 211 has a magnetic body 212 of a rectangular solid shape, and a spiral coil 213 covered by the magnetic body 212, where one end of the coil 213 connects to the external terminal 214, while the other end connects to the external terminal 215. As shown in FIG. 4, the magnetic body 212 has a structure wherein a total of 20 layers of magnetic layers ML1 to ML6 are integrated, whose length is approx. 3.2 mm, width is approx. 1.6 mm and height is approx. 0.8 mm. The magnetic layers ML1 to ML6 each have a length of approx. 3.2 mm, width of approx. 1.6 mm and thickness of approx. 40 μm. The coil 213 has a structure wherein a total of five coil segments CS1 to CS5 and a total of four relay segments IS1 to IS4 connecting the coil segments CS1 to CS5 are spirally integrated, where the number of windings is approx. 3.5. This coil 213 is made of Ag grains whose d50 is 5 μm.

The four coil segments CS1 to CS4 have a C shape, while the coil segment CS5 has a band shape, where these coil segments each have a thickness of approx. 20 μm and width of approx. 0.2 mm. The topmost coil segment CS1 continuously has an L-shaped leader part LS1 used for connection with the external terminal 214, while the bottommost coil segment CS5 continuously has an L-shaped leader part LS2 used for connection with the external terminal 215. Each of the relay segments IS1 to IS4 has a pillar shape penetrating one of the magnetic layers ML1 to ML4, where each bore diameter is approx. 15 μm. The external terminals 214, 215 extend to each end surface of the main component body 211 in the lengthwise direction as well as to the four side faces near the end surface, respectively, and have a thickness of approx. 20 μm. The one external terminal 214 connects to the edge of the leader part LS1 of the topmost coil segment CS1, while the other external terminal 215 connects to the edge of the leader part LS2 of the bottommost coil segment CS5. These external terminals 214, 215 are made of Ag grains whose d50 is 5 μm.

To manufacture the laminated inductor 210, a doctor blade was used as a coating machine to apply a prepared magnetic paste to the surface of a plastic base film (not illustrated), and the coated film was dried with a hot-air dryer under the conditions of approx. 80° C. for approx. 5 minutes to produce first to sixth sheets corresponding to the magnetic layers ML1 to ML6 (refer to FIG. 4) and having a size that allows for forming multiple cavities. The magnetic paste contained the aforementioned material grains by 85 percent by weight, butyl carbitol (solvent) by 13 percent by weight, and polyvinyl butyral (binder) by 2 percent by weight. Next, a stamping machine was used to piece the first sheet corresponding to the magnetic layer ML1 to form through holes corresponding to the relay segment IS1 in a specified arrangement. Similarly, through holes corresponding to the relay segments IS2 to IS4 were formed in specified arrangements in the second through fourth sheets corresponding to the magnetic layers ML2 to ML4, respectively.

Next, a screen printer was used to print a prepared conductive paste on the surface of the first sheet corresponding to the magnetic layer ML1, and the printed sheet was dried with a hot-air dryer under the conditions of approx. 80° C. for approx. 5 minutes to produce a first printed layer corresponding to the coil segment CS1 in a specified arrangement. Similarly, second through fifth printed layers corresponding to the coil segments CS2 to CS5 were formed in specified arrangements on the surfaces of the second through fifth sheets corresponding to the magnetic layers ML2 to ML5, respectively. The composition of conductive paste was 85 percent by weight of Ag material, 13 percent by weight of butyl carbitol (solvent), and 2 percent by weight of polyvinyl butyral (binder). Since the through holes formed in specified arrangements in the first to fourth sheets corresponding to the magnetic layers ML1 to ML4, respectively, were positioned in a manner overlapping with the ends of the first to fourth printed layers in specified arrangements, the conductive paste was partially filled in the through holes when the first to fourth printed layers were printed, to form first to fourth filled areas corresponding to the relay segments IS1 to IS4, respectively.

Next, a suction transfer machine and press machine (neither is illustrated) were used to stack in the order shown in FIG. 4 the first to fourth sheets having a printed layer and filled area (corresponding to the magnetic layers ML to ML4), the fifth sheet having only a printed layer (corresponding to the magnetic layer ML5), and sixth sheet having no printed layer or filled area (corresponding to the magnetic layer ML6), and then thermally compress the stack to produce a laminate. Next, a dicing machine was used to cut the laminate to the size of the main component body to produce a chip-before-heat-treatment (containing the magnetic body and coil before heat treatment). Next, a sintering furnace, etc., was used to heat multiple units of chips-before-heat-treatment in atmosphere at once. This heat treatment included a binder removal process and oxide film-forming process, where the binder removal process was implemented under the conditions of approx. 300° C. for approx. 1 hour, while the oxide film-forming process was implemented under the conditions of approx. 750° C. for approx. 2 hours. Next, a dip coater was used to apply the aforementioned conductive paste to both ends of the main component body 211 in the lengthwise direction, which was then baked in a sintering furnace under the conditions of approx. 600° C. for approx. 1 hour and, as the solvent and binder dissipated and Ag grains were sintered in this baking process, external terminals 214, 215 were produced.

Next, the obtained laminated inductor was soaked in a solution containing each resin material to fill the resin material in the voids, after which heat treatment was applied at 150° C. for 60 minutes to cure the resin material. The types of resin materials and degrees of filling are shown in Table 1. The degree of filling was controlled by adjusting the dilution concentration and viscosity of the resin. "Silicone type" in Table 1 indicates a resin having the basic structure illustrated in (1) below, while "Epoxy type" indicates a resin having the basic structure illustrated in (2) below.

[Chemical Formula 1]

(1)

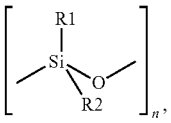

(2)

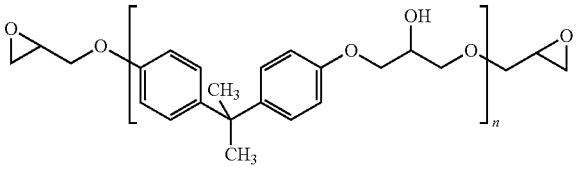

A section of the obtained laminated inductor was observed by a SEM (3,000 magnifications) to confirm presence of bonding portions where adjacent metal grains are bonded via oxide film formed on the surfaces of the metal grains constituted by a soft magnetic alloy, as well as bonding portions of metal grains bonding to each other in areas where no oxide film was present.

Comparative Example 1

A laminated inductor was manufactured in the same manner as in the Examples, except that no resin material was filled. FIG. 6 is a schematic section view of the magnetic material layer in the comparative example. In the magnetic material 2 shown in FIG. 6, regions where metal grains 11 and oxide film 12 are absent are not filled with resin material and remain as voids 30.

Evaluation

The laminated inductors obtained by the Examples and Comparative Example were put through the following reliability tests at L=1.0 uH, Q (1 MHz)=30, and Rdc=0.1Ω (n=100):

(1) High-temperature load test: 0.8 A is applied at 85° C. for 1,000 hours.

(2) Accelerated load test: 1.2 A is applied at 85° C. for 300 hours.

(3) Moisture-resistance load test: 0.8 A is applied at 60° C. and 95% humidity for 300 hours.

After each test, samples whose L or Q had dropped to 70% or less of the initial value were deemed defective. Table 1 summarizes the manufacturing conditions and defective percentages.

TABLE 1

| | Type of resin | Filling ratio | Percent defective in high-temperature load test | Percent defective in accelerated load test | Percent defective in moisture-resistance load test |
|---|---|---|---|---|---|
| Comparative Example 1 | None | 0% | 90% | 80% | 95% |
| Example 1 | Silicone type | 5% | 10% | 10% | 10% |
| Example 2 | | 15% | <1% | 0% | <1% |
| Example 3 | | 20% | 0% | 0% | 0% |
| Example 4 | Epoxy type | 5% | 15% | 10% | 15% |
| Example 5 | | 15% | <1% | 0% | <1% |
| Example 6 | | 20% | 0% | 0% | 0% |

As shown above, Examples where a resin was filled presented improved reliability, and this effect was particularly prominent when the filling ratio was 15% or more.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. In this disclosure, any defined meanings do not necessarily exclude ordinary and customary meanings in some embodiments. Also, in this disclosure, "the invention" or "the present invention" refers to one or more of the embodiments or aspects explicitly, necessarily, or inherently disclosed herein.

The present application claims priority to Japanese Patent Application No. 2011-100095, filed Apr. 27, 2011 and Japanese Patent Application No. 2012-068444, filed Mar. 23, 2012, the disclosure of which is incorporated herein by reference in their entirety. In some embodiments, as the magnetic body and related structures, those disclosed in U.S. Patent Application Publication No. 2011/0267167 A1 and No. 2012/0038449, co-assigned U.S. patent application Ser. No. 13/313,982, Ser. No. 13/313,999, and Ser. No. 13/351,078 can be used, each disclosure of which is incorporated herein by reference in their entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor, comprising:

a laminate constituted by multiple magnetic material layers, and coil conductors formed in a spiral pattern in the laminate, where the coil conductors have conductive patterns formed on magnetic material layers, respectively, and via hole conductors that penetrate through the magnetic material layers and electrically connect multiple conductive patterns formed thereon;

wherein the magnetic material layers are layers of a magnetic material having multiple metal grains constituted by a Fe—Si-M soft magnetic alloy (where M is a metal element that oxidizes more easily than Fe) and oxide film formed on the surface of the metal grains and made of an oxide of the soft magnetic alloy, the magnetic material has bonding portions where adjacent metal grains are connected via the oxide film formed on the respective surfaces of the adjacent metal grains as well as bonding portions where metal grains are interconnected in areas where no oxide film is present, and voids where no metal grain nor oxide film is present are generated by agglomeration of the metal grains, wherein at least some of the voids are filled with a resin material.

2. A laminated inductor according to claim 1, wherein the resin material is filled in at least 15% of the voids, which is a ratio of the area of voids filled with the resin material to the area of all the voids as observed on a cross section of the magnetic material layer.

3. A laminated inductor according to claim 1, wherein the resin material is constituted by at least one type of resin selected from the group consisting of silicone resins, epoxy resins, phenol resins, silicate resins, urethane resins, imide resins, acrylic resins, polyester resins and polyethylene resins.

4. A laminated inductor according to claim 2, wherein the resin material is constituted by at least one type of resin selected from the group consisting of silicone resins, epoxy resins, phenol resins, silicate resins, urethane resins, imide resins, acrylic resins, polyester resins and polyethylene resins.

5. A laminated inductor according to claim 1, wherein M is Cr.

6. A laminated inductor according to claim 1, wherein the voids filled with the resin material are continuous.

* * * * *